United States Patent [19]

Roth

[11] Patent Number: 5,028,862

[45] Date of Patent: Jul. 2, 1991

[54] VOLTAGE FOLLOWER CIRCUIT FOR USE IN POWER LEVEL CONTROL CIRCUITS

[75] Inventor: Roger R. Roth, Minnetonka, Minn.

[73] Assignee: Honeywell Inc., Minneapolis, Minn.

[21] Appl. No.: 457,214

[22] Filed: Dec. 26, 1989

[51] Int. Cl.[5] ..... G05F 1/56; G05F 1/63

[52] U.S. Cl. ..... 323/273; 323/293; 323/325; 315/194; 315/291

[58] Field of Search ..... 323/265, 273, 274, 280, 323/300, 320, 321, 322, 323, 324, 325, 326, 349, 293, 298, 905; 315/194, 195, 291, 294, 307, DIG. 4

[56] References Cited

U.S. PATENT DOCUMENTS

| | | | |
|---|---|---|---|
| 4,144,478 | 3/1979 | Nuver | 315/291 |
| 4,575,654 | 3/1986 | Basch . | |
| 4,628,230 | 12/1986 | Krokaugger . | |
| 4,642,526 | 2/1987 | Hopkins . | |
| 4,651,060 | 3/1987 | Clark . | |
| 4,804,916 | 2/1989 | Frank . | |
| 4,837,506 | 6/1989 | Patterson . | |

*Primary Examiner*—R. Skudy
*Assistant Examiner*—Emanuel Todd Voeltz
*Attorney, Agent, or Firm*—Edward Schwarz

[57] ABSTRACT

A power control system includes a voltage follower circuit which may be interposed between a load power control circuit which adjusts the level of power applied to a load, and a variable impedance whose internal impedance prescribes the desired level of power. A feedback voltage from the output of the voltage follower circuit is compared with a corresponding voltage across the variable impedance and the difference between them is used to drive the output voltage of the voltage follower circuit toward the input voltage. The voltage follower circuit permits control by a single variable impedance of many more load power control circuits than a single variable impedance can normally handle, and without appreciably affecting the power level as a function of the impedance level. This circuit is particularly useful in a system for controlling the level of light received from fluorescent light fixtures controlled by electronic ballasts.

4 Claims, 1 Drawing Sheet

VOLTAGE FOLLOWER CIRCUIT FOR USE IN POWER LEVEL CONTROL CIRCUITS

BACKGROUND OF THE INVENTION

For certain electrical devices the ability to control or adjust the level of power supplied to them is advantageous. In these devices what may be generally described as a load power control circuit provides the function of allowing a user to provide this control by adjustment of an element, for example a potentiometer, in the circuit.

There are a number of situations where this need arises. In a particular application of interest, it is desirable to be able to allow manual control of the illumination level provided by fluorescent lighting. In the most recent types of such dimmable fluorescent lighting systems, power is provided to each individual fixture through what is called an electronic ballast which functions in a fluorescent lighting fixture as the aforementioned load power control circuit. In one particular commercial design, the dimming level is adjusted by varying the value of an external variable control impedance which is connected across a pair of the ballast's control terminals. There is, internal to the ballast, a current source in parallel with a resistance across the pair of ballast control terminals. By varying the control impedance across the ballast control terminals a dimming control signal voltage is created across the control terminals which is sensed by other elements of the ballast's internal circuitry and in response to which vary the illumination level provided by the fixture of which the ballast is a part. The control voltage across the control terminals varies from about 1 volt at minimum illumination to about 10 v. at full brightness. Each ballast provides power to a pair of fluorescent bulbs.

It is possible, by ganging the control terminals for the ballasts across the control impedance circuit terminals, to connect a number of individual ballasts' control terminals to a single control impedance circuit. In this commercial design, the control impedance circuit includes active semiconductor elements which make the control characteristics of the impedance circuit as a function of its adjustment potentiometer resistance nearly insensitive to the number of ballasts controlled by the impedance circuit. That is, the illumination level of individual fixtures is very nearly the same for a given mechanical position of the control impedance circuit's adjustable element regardless of the number of ballasts controlled by the impedance.

The control impedance circuit has the capability of controlling the dimming for as many as 60 individual ballasts. The limitation on the number of ballasts which may be controlled by a single control impedance is directly related to the ability of the impedance to sink the current which each individual ballast produces at its control terminals.

In certain applications it is useful to be able to control more than the designed-for number of 60 fixtures from a single impedance. While 60 fixtures at first blush appears to be a large number, many commercial and office buildings have literally hundreds of fluorescent fixtures whose control by a single control element is sometimes desirable. To provide a control impedance with greater capability than the 60 ballasts requires a built-in power supply which increases its production and installation cost. It is desirable to devise some means of avoiding these aforementioned limitations. In particular, a means for transparently interfacing between a single control impedance and a large number of fluorescent fixtures would be very useful.

There are a number of references pertaining to varying the amount of electric power applied to a load. In the particularly pertinent electric lamp dimming control field, U.S. Pat. No. 4,628,230 shows a light dimming circuit for use with a plurality of lamps and which uses a feedback signal in controlling the illumination level. U.S. Pat. Nos. 4,645,979; 4,651,060; 4,686,427; 4,704,563; 4,712,045; and 4,717,863 are other references showing dimming circuits for fluorescent lamps.

A discussion of a particular aspect of the theory of circuit equivalence will be helpful in understanding the invention to be described. The concept of a current source is well known to those skilled in the electronic arts, and indeed, the commercial embodiment of the electronic ballast mentioned above uses a current source in parallel with a resistor as the power source at its input terminals. It is known that one can substitute a current source in parallel with a resistor for a voltage source in series with a resistor of a different value to provide equivalent electrical characteristics. Therefore, for the remainder of this discussion, one should consider a current source in parallel with a resistor of some value to be interchangeable with a voltage source in series connection with a resistor. In particular, use of the term "voltage source" is not meant to limit the disclosure involved to that specific embodiment, and the current source equivalent should be understood to be included in the term.

BRIEF DESCRIPTION OF THE INVENTION

As mentioned above, in certain power control systems the level of power is controlled by adjusting the external impedance across control terminals of a load power control circuit which responds by regulating the power to the load. This invention particularly relates to those systems adapted for varying the power supplied to a fluorescent light fixture to vary the illumination from the fixture and which include electronic ballasts which comprise the load power control circuits. These load power control circuits provide at their control terminals a voltage which varies in response to the value of a variable control impedance across the control terminals. The invention comprises a voltage follower circuit to be interposed between this variable control impedance and the control terminals of a large number of load power control circuits to recreate at the control terminals of the load power control circuits, the conditions at the output terminals of the variable control impedance.

Such a voltage follower circuit has a pair of input terminals to which may be connected the variable control impedance and a pair of output terminals to which may be connected the control terminals of a plurality of said load power control circuits in a ganged configuration so as to allow control of a plurality of individual loads with a single variable impedance with substantially unchanged control characteristics. The voltage follower circuit in a broadly stated description includes a voltage source; a resistor in series connection with the voltage source across the voltage follower circuit input terminals; and a variable output impedance having its output terminals forming the output terminals of the voltage follower circuit and an input terminal controlling the impedance between the variable output impedance output terminals, and where said output impedance increases as the input terminal voltage decreases and said impedance decreases as its input terminal voltage increases. There is further a voltage sensing means receiving as a first input the voltage across the variable output impedance output terminals and as a second input the voltage across the voltage follower circuit input terminals, for providing an output signal to the input terminal of the variable output impedance representative of the difference between the voltages of the first and second inputs. This feedback of the voltage across the variable output impedance allows the voltage sensing means to drive the variable impedance to accurately mimic the voltage at the input terminals of the voltage follower circuit.

The particular purpose which this invention achieves is to drive a very large number of loads and achieve simultaneous and identical variation in the power input to them. The invention has particular application in controlling with a single control impedance, the power input to large lighting installations having literally hundreds of fixtures.

Other purposes and advantages will become apparent from the description of the invention which follows. dr

DESCRIPTION OF THE PREFERRED EMBODIMENT

Figure 1:
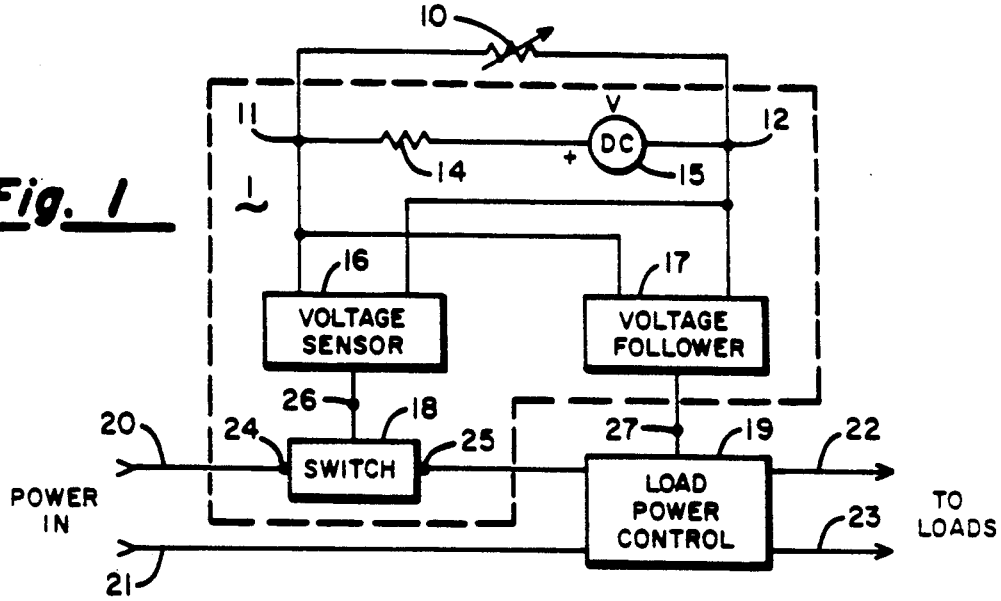
FIG. 1 is a block diagram of an integrated power and on/off control for a load such as a light fixture.

The block diagram shown in FIG. 1 is a block diagram of a circuit providing power adjustment to a load along with an on/off function. The user of the load can adjust power and turn it on and off by properly setting a variable control impedance 10. While the representation in FIG. 1 of impedance 10 is as a simple variable resistor, in fact its commercial embodiment is instead a circuit including active semiconductor electrical components, the details of which are not relevant to this invention. Power for these active components is received at control terminals 11 and 12 from a DC voltage source 15 in series with a resistor 14.

The on/off and power level control functions are shown as individual elements in FIG. 1, with the on/off function provided by a voltage sensor 16 and a switch 18. When switch 18 is closed, electric current passes between switch terminal 24 and switch terminal 25, through load power control circuit 19, and through terminals 22 and 23 to the load. The power control function is performed by a voltage follower circuit 17 supplying a control signal through conductor 27 to load power control circuit 19. The load power control circuit 19 in the embodiment of this invention pertaining to fluorescent lighting controls comprises the electronic ballast previously discussed.

In the design of a commercial embodiment, it is convenient to combine the voltage source 15, the resistor 14, the voltage sensor 16 and switch element 18, and the voltage follower circuit 17 in a single modular unit 1 permitting power to the load to be adjusted and switched under control of the variable impedance 10 only.

Switch 18 under the control of voltage sensor 16 disconnects the load from power terminals 20 and 21 in response to voltage between terminals 11 and 12 falling within a preselected range and connects the load to power terminals 20 and 21 if the voltage between terminals 11 and 12 is outside of this range. In the commercial embodiment contemplated, this preselected voltage range is from 0.1 to about 0.5 v. When the voltage between terminals 11 and 12 is from 0 to 0.5 volt, voltage sensor 16 provides a signal voltage at terminal 26 to which switch 18 responds by opening the connection between terminals and 24 and 25. When the voltage between terminals 11 and 12 is above about approximately 0.8 v., switch 18 makes electrical connection between terminals 24 and 25. In the range between 0.5 and 0.8 v., the condition of switch 18 will not change.

The voltage produced on terminal 27 of voltage follower circuit 17 in the preferred embodiment, precisely emulates or mirrors the voltage between terminals 11 and 12 of impedance 10. It is also preferable that the input interface for these voltage follower circuits 17 be compatible with that of the load power control circuits 19 so that the same commercial embodiment of impedance 10 may be interchangeably connected to the input terminals of either. The input interface for load power circuit 19 includes a DC current source and a parallel resistor. The values of resistor 14 and the series voltage source 15 are chosen so that the input interface of voltage follower circuit 17 is compatible with the input of load power control circuit 19. Preferably, the design of voltage follower circuit 17 is such that a substantial number of these voltage follower circuits may be gang connected at their input or control terminals 11 and 12 to impedance 10. This allows many more load power control circuits 19 to be controlled by a single impedance 10 than if no voltage follower circuits 17 were present. Further, it is preferable that the input interface for voltage follower circuit 17 be compatible with the input of load power control circuit 19 so that both types of circuits may be intermixed at their input terminals to the impedance 10.

Since the embodiment of voltage follower circuit 17 allows the commercially available variable impedance 10 to drive as many as ten voltage followers 17, it can be seen that use of a multiple number of these voltage follower circuits 17 allows as many as 600 individual load power control circuits 19 to be controlled by a single impedance 10 as opposed to the 60 that can be controlled by a single impedance 10 without the interposition of the voltage follower circuit 17.

POWER ADJUSTMENT

Voltage follower 17 and load power control 19 permit one to adjust the power delivered to the load. Again, the impedance between terminals 11 and 12 as measured by sensing the voltage across these terminals control the level of power delivered to the load. The design of circuits 17 and 19 is such that the amount of power delivered to the load is highest when the voltage between terminals 11 and 12 is highest and becomes lower as the voltage and impedance across these terminals becomes lower.

Figure 2:
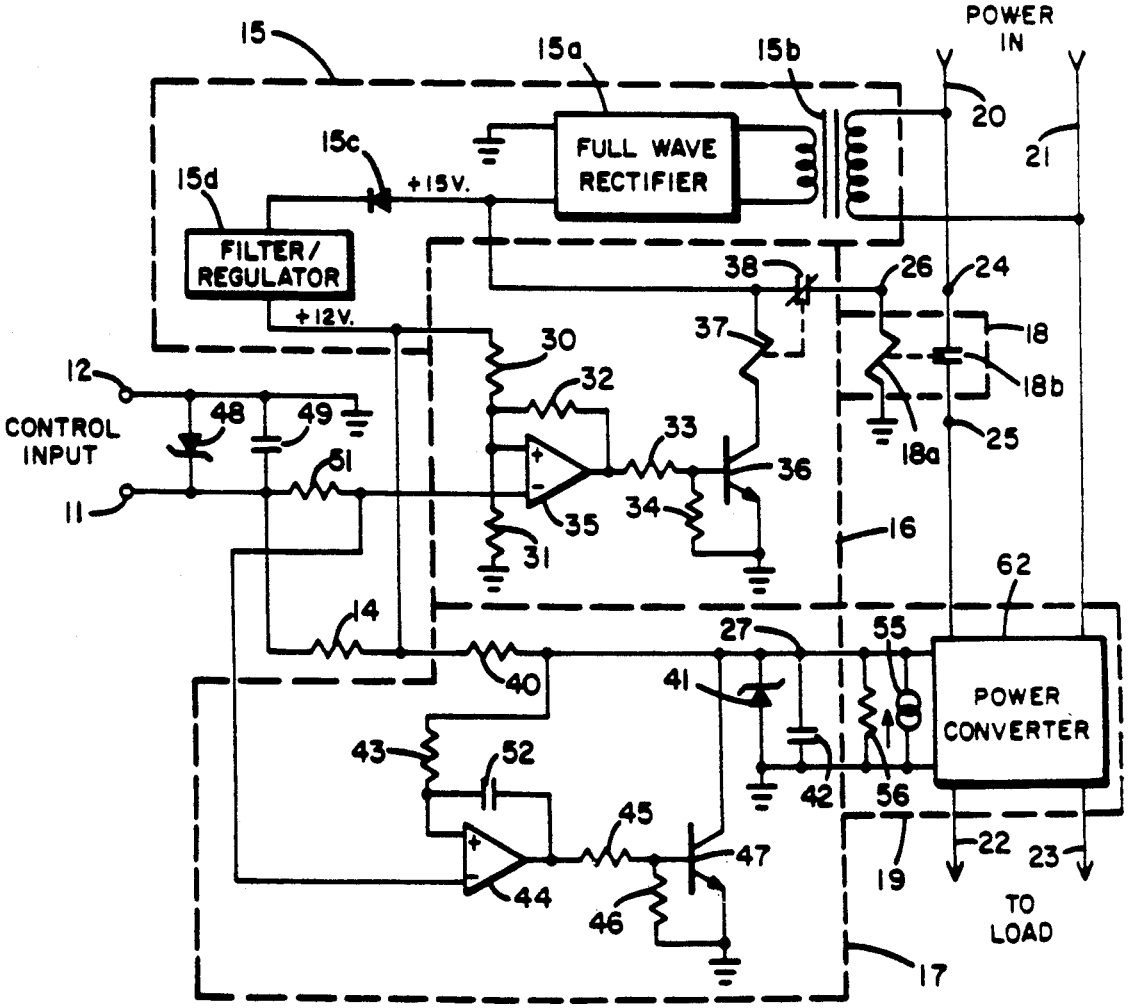
FIG. 2 is a circuit diagram for the on/off and power adjusting function of the block diagram of FIG. 1.

The individual circuit components of the three block elements, voltage sensor 16, voltage follower 17 and switch 18 combined in the single modular unit 1 are shown in FIG. 2. In FIG. 2 DC voltage source 15 is shown as comprising a transformer **15*b* receiving power from terminals 20 and 21 and providing a 15 volt AC output to full wave rectifier 15*a*. The output of full wave rectifier 15*a* is provided to a filter/regulator element 15*d* through coupling diode 15*c*. The output of filter/regulator element 15d is +12 v. DC provided to the resistor 14 for the control signal and to power the operational amplifiers 35 and 44. The unregulated and unfiltered DC output from rectifier 15a is used for certain functions of the switch element 18**.

For the purposes of the discussion which follows involving both operational amplifiers 35 and 44, these devices may be taken to be high gain voltage amplifiers having a differential input. By a differential input is meant that a variable or control voltage can be applied to either or both of the + and − terminals. The output of each operational amplifier 35 and 44 is a voltage which is a large multiple, say on the order of several hundred to several thousand, of the difference of the voltage between the plus and minus input terminals. When the − terminal voltage exceeds the voltage on the + terminal the output is simply driven to 0 v. (ground). Because of the large voltage amplification, and the fact that the output voltage can never exceed the voltage of the power applied to these amplifiers, there is a relatively narrow range of input voltage differences over which the output is between the 0 v. and 12 v. extremes.

The voltage at terminal 11 and provided through resistor 51 is applied to the − input terminal of amplifier 44. A feedback voltage is applied to the + input terminal of operational amplifier 44 through resistor 43. The source of this feedback voltage will be identified later. The output of amplifier 44 is applied to a voltage divider circuit comprising resistors 45 and 46. The output voltage from the voltage divider at the connection between the two resistors 45 and 46 is applied to the base of a transistor 47. Transistor 47 functions as a variable impedance to hold the voltage at its collector very close to the voltage on terminal 11. The voltage at the collector of transistor 47 forms the feedback voltage mentioned just above provided to the + input terminal of operational amplifier 44. A capacitor 52 connected between the + input terminal and the output of operational amplifier 44 provides stability of the amplifier 44 output. As the transistor 47 collector voltage increases for a given control terminal 11 voltage, transistor 47 is driven more strongly into conduction which reduces its collector voltage. Accordingly, it can be seen that the voltage at the collector of transistor 47 and terminal 27 will always be a few millivolts above the input terminal 11 voltage applied to the − input terminal of amplifier 44. It thus can be seen that the operation of load power circuit 19 when driven by voltage follower circuit 17 is essentially identical to its operation if the variable impedance connected between terminal 12 (ground) and terminal 11 were shifted from that point to replace the voltage follower output connections at terminal 27 and terminal 64 (ground) of control circuit 19. Zener diode 41 and capacitor 42 provide protection against static electricity voltage surges at the output of voltage follower circuit 17 in the same manner that similar components 48 and 49 provide similar input protection.

Current source 55 and resistor 56 provide power for the variable control impedance which for this invention's purpose is connected across the input terminals 11 and 12 instead of being attached to terminal 27 as originally intended. Current source 55 and resistor 56 together with power converter 62 comprise the load power control circuit 19 shown in FIG. 1. The design of the voltage follower circuit 17 allows complete compatibility between the output of circuit 17 and input of circuit 19.

ON/OFF CONTROL

Turning first to switch element 18, a voltage divider comprising resistors 30 and 31 is connected between the output of filter/regulator element 15d and ground. The values of resistors 30 and 31 are chosen such that approximately 0.5 v. appears at the connection between them. The voltage produced at the connection between resistors 30 and 31 is applied to the + input terminal of an operational amplifier 35.

The − terminal input receives the control voltage applied to terminal 11 through resistor 51. Resistor 51 is present merely to attenuate potential static discharges presented on terminal 12. Because its resistance may be on the order of 10,000 ohms or so, very much lower than the input impedance of amplifier 35, it has no effect on the response of amplifier 35.

The voltage across control input terminals 11 and 12 is supplied by the output of filter/regulator element 15d applied through resistor 14. Thus it can be seen that as control impedance 10 is changed across terminals 11 and 12 the voltage at terminal 12 will change, increasing as the control impedance value increases and decreasing as control impedance decreases. Zener diode 48 and capacitor 49 are included simply for further protection against static electricity discharges which have the potential to damage the semiconductor elements within amplifiers 35 and 44.

The output of amplifier 35 is applied to a pair of series-connected resistors 33 and 34. Resistor 33 limits current flow from amplifier 35, and these two resistors also function as a voltage divider to assure that transistor 36 is cut off when the output of amplifier 35 is low. A feedback resistor 32 connects the output of amplifier 35 to the + input terminal of amplifier 35. The purpose of resistor 32 is to create a dead band which stabilizes the response of amplifier 35 so that small variations in the − terminal voltage when only slightly more negative (within about 0.3 v.) than the voltage on the + terminal will not cause the output of amplifier 35 to change.

The voltage output at the connection between resistors 33 and 34 is applied to the base of an NPN transistor 36. The emitter of transistor 36 is connected to ground and the collector is connected to the winding 37 of a first relay. The first relay has normally closed contacts 38 controlled by winding 37, so that contacts 38 conduct when transistor 36 is cut off and no current flows through winding 37. Unregulated power from full wave rectifier 15a is applied through contacts 38 to a terminal 26 and then to the winding 18a of a second relay comprising the switch 18 discussed in connection with FIG. 1. Winding 18a controls normally open contacts 18b which are connected between terminals 24 and 25. It can be seen that when contacts 18b are closed power can flow from terminals 20 and 21 to load terminals 22 and 23 through the power converter element 62 shown.

Circuit operation is controlled by the value of the impedance connected between terminals 11 and 12. In the commercial embodiment contemplated the 12 v. potential applied to terminal 11 through resistor 14 is dropped by the control impedance 10 so that voltage varies from a maximum of 10 v. to a minimum of 0.1 to 0.2 v. When voltage at terminal 11 exceeds the 0.5 v. applied to the + input terminal of amplifier 35, its output to resistors 33 and 34 is also close to 0 v. so that the voltage at the base of transistor 36 is also 0 v. 0 v. applied to the base of transistor 36 causes transistor 36 to be cut off so that no current flows between its collector and emitter and therefore no current flows through the first relay's winding 37. Therefore, contacts 38 are closed and current flows through the winding 18*a* which holds contacts 18*b* closed. Thus power can flow to load terminals 22 and 23 through power converter 62.

When voltage at terminal 11 is below 0.5 v. the output of amplifier 35 is at approximately 10 v. The current supplied to the base of transistor 36 through resistor 33 drives transistor 36 into conduction. When transistor 36 conducts, then winding 37 causes contacts 38 to open so they no longer conduct. When contacts 38 do not conduct then no current is allowed to flow to terminal 26 and through winding 18*a*, causing contacts 18*b* to open, disconnecting load terminals 22 and 23 from the power terminals 20 and 21. Setting the control impedance 10 to a value which reduces the voltage across terminals 11 and 12 to less than 0.5 v. in effect functions to the perception of the user as an off position of the impedance 10.

The inductive surge from the collapsing fields of relay windings 37 and 18*a* while transistor 47 is shutting off and contacts 18*b* are opening ma result in excessive voltage across the emitter and collector of transistor 47 and arcing across contacts 38. The damage which these surges may cause makes it preferable to include a diode (not shown) across windings 37 and 18*a* to dissipate this surge and prevent damage to transistor 47 and contacts 38. This is a well known design expedient.

As mentioned in connection with FIG. 1, it is important that there be an appreciable range between the voltage across terminals 11 and 12 at which contacts 18*b* are opened, and the voltage at which contacts 18*b* are closed so they conduct. This is the function of feedback resistor 32 and the dead band that it creates. When the − input terminal of amplifier 35 falls below 0.5 v., the output of amplifier 35 rises to approximately 10 v. Resistor 32 is chosen of a size sufficient to pull up the voltage on the + input of amplifier 35 to approximately 0.8 v. or so. When the impedance 10 increases in value and the voltage across terminals 11 and 12 increases as well, it must reach the 0.8 v. level before the output of amplifier 35 drops to around 0.5 v. to cut off transistor 36 and eventually cause contacts 18*b* to close. Thus, resistor 32 shifts the voltage at the + input terminal of amplifier up a few tenths of a volt when the voltage on the − terminal of amplifier is low, and pulls the voltage on the + terminal of amplifier 35 down when the amplifier 35 output is low. Accordingly, resistor 32 adds stability so that normal variations in the voltage across terminals 11 and 12 resulting from fluctuations in power supply voltage or impedance 10 will not trigger amplifier 35 to change its output other than when the voltage at terminal 11 is changed by manual adjustment of impedance 10.

The following component values or designations for these two circuits are preferred:

| | |
|---|---|
| Resistors 14, 40, 34, 46 61 | 4,700 Ω |
| Rectifier 15 a | formed of type 1N4004* diodes |
| Diode 15 c | type 1N4004 |
| Resistor 30 | 240,000 Ω |
| Resistors 31, 33, 45, 43, 51 | 10,000 Ω |
| Resistor 32 | 1,000,000 Ω |
| Operational amplifiers 35, 44 | type LM358N* |
| Transistors 36, 47 | type 2N3904* |
| Capacitors 42, 48, 52 | .1 mfd. |

-continued

| | |
|---|---|
| Zener diodes 41, 48 | 1N4740A* 10 v., 1 w. |
| First relay | Aromat Corp.**, type VC20-1a-DC12V |
| Second relay | Aromat Corp., type HD1E-M-DC12V |

*Semiconductor designations are generic.
**A member of the Matsushita group.

What I claim is:

1. In an electric power control system of the type including a load power control circuit for varying the level of power from a power source to a load according to the value of a variable control impedance applied across control terminals of said load power control circuit, said load power control circuit of the type providing at its control terminals a voltage varying in response to the value of the variable control impedance, a voltage follower circuit having a pair of input terminals between which may be connected to the variable control impedance and a pair of output terminals to which may be connected the control terminals of a plurality of said load power control circuits in a ganged configuration so as to allow control of a plurality of individual loads with a single variable control impedance with substantially unchanged control characteristics, comprising a) a voltage source;

b) a resistor in series connection with the voltage source across the voltage follower circuit input terminals;

c) a variable output impedance having its output terminals forming the output terminals of the voltage follower circuit and an input terminal for controlling the impedance between the variable output impedance output terminals, said output impedance value increasing as the input terminal voltage decreases and said output impedance value decreasing as the input terminal voltage increases; and d) voltage sensing means receiving as a first input the voltage across the variable output impedance output terminals and as a second input the voltage across the voltage follower circuit input terminals, for providing an output voltage signal to the input terminals of the variable output impedance representative of the difference between the voltages of the first and second inputs of the voltage sensing means.

2. The power control system of claim 1 wherein the voltage sensing means comprises an operational amplifier receiving at one input terminal the voltage between the voltage follower circuit input terminals and at its other input terminal the voltage across the variable output impedance, and providing as output an amplified difference between the voltages of the input signals.

3. The power control system of claim 2, wherein the voltage sensing means further comprises a voltage divider receiving the output of the operational amplifier and providing a voltage output equal to a fixed fraction of the operational amplifier output and wherein the variable output impedance comprises to transistor whose collector and emitter comprise the variable output impedance' output terminals.

4. The power control system of claim 3, wherein the operational amplifier includes + and − input terminals, said operational amplifier providing an output voltage becoming increasingly positive within a preselected range of the difference between the voltages applied to the + and − input terminals while the + input terminal voltage is more positive than the − input terminal voltage, and the voltage sensing means includes a resistor connecting the collector of the transistor to the + input terminal.

* * * * *

UNITED STATES PATENT AND TRADEMARK OFFICE

CERTIFICATE OF CORRECTION

PATENT NO. : 5,028,862

DATED : July 2, 1991

INVENTOR(S) : Roger R. Roth

It is certified that error appears in the above-identified patent and that said Letters Patent is hereby corrected as shown below:

Column 8, Claim 1, Line 10 (of the claim), delete "to".

Column 8, Claim 3, Line 6 (of the claim), delete "to" and insert --a--.

Signed and Sealed this

Twenty-ninth Day of December, 1992

*Attest:*

DOUGLAS B. COMER

*Attesting Officer*

*Acting Commissioner of Patents and Trademarks*